US011447923B2

(12) United States Patent
Getts et al.

(10) Patent No.: US 11,447,923 B2
(45) Date of Patent: Sep. 20, 2022

(54) PILE WITH POSITIVE STOP

(71) Applicant: Edgerton Forge, Inc., Edgerton, OH (US)

(72) Inventors: Brian Getts, Avilla, IN (US); Bronson Knecht, Edgerton, OH (US); Christian Pearson, St. Joe, IN (US); Gordon Miller, Defiance, OH (US)

(73) Assignee: Edgerton Forge, Inc., Edgerton, OH (US)

( * ) Notice: Subject to any disclaimer, the term of this patent is extended or adjusted under 35 U.S.C. 154(b) by 0 days.

(21) Appl. No.: 17/021,814

(22) Filed: Sep. 15, 2020

(65) Prior Publication Data

US 2022/0081861 A1 Mar. 17, 2022

(51) Int. Cl.

| | |
|---|---|
| ***E02D 5/52*** | (2006.01) |
| ***E02D 27/12*** | (2006.01) |
| ***E02D 5/24*** | (2006.01) |
| *E02D 5/28* | (2006.01) |

(52) U.S. Cl.

CPC ..... *E02D 5/526* (2013.01); *E02D 5/24* (2013.01); *E02D 27/12* (2013.01); *E02D 5/285* (2013.01); *E02D 2200/1685* (2013.01); *E02D 2250/00* (2013.01); *E02D 2250/0015* (2013.01); *E02D 2250/0023* (2013.01); *E02D 2300/0029* (2013.01); *E02D 2300/0045* (2013.01); *E02D 2600/20* (2013.01)

(58) Field of Classification Search

CPC ..... E02D 5/526; E02D 5/52; E02D 5/523; E02D 5/24; E02D 27/12; E02D 5/285

See application file for complete search history.

(56) References Cited

U.S. PATENT DOCUMENTS

| | | | | |
|---|---|---|---|---|
| 9,506,214 | B1 * | 11/2016 | Kaufman | E02D 27/12 |
| 9,863,114 | B2 | 1/2018 | Kaufman et al. | |
| 10,294,623 | B2 | 5/2019 | Kaufman et al. | |
| 10,844,569 | B2 | 11/2020 | Kaufman et al. | |
| 2016/0333540 | A1 | 11/2016 | Kaufman et al. | |
| 2017/0037590 | A1 | 2/2017 | Kaufman et al. | |
| 2018/0155891 | A1 | 6/2018 | Kaufman et al. | |
| 2019/0127940 | A1 | 5/2019 | Kaufman et al. | |
| 2021/0071381 | A1 | 3/2021 | Kaufman et al. | |
| 2021/0254298 | A1 | 8/2021 | Kaufman et al. | |

FOREIGN PATENT DOCUMENTS

| | | | |
|---|---|---|---|
| AT | 510951 | * | 8/2012 |
| JP | 2001159183 | * | 6/2001 |
| KR | 2020075648 | * | 6/2020 |

* cited by examiner

*Primary Examiner* — Sean D Andrish

(74) *Attorney, Agent, or Firm* — Quarles & Brady LLP

(57) ABSTRACT

A pile system for support structures includes at least two piles each having a first end, a second end, and a cylindrical elongate body. Each cylindrical elongate body has an inner surface and an outer surface, extends from the first end toward the second end, and defines an internal cavity with a longitudinal axis. Each pile further includes a transition region between the elongate body and the second end, the transition region including an annular seating shoulder disposed on the inner surface of the cylindrical elongate body that defines a step increase from a primary inner diameter to a secondary inner diameter. The first end of a first pile of the at least two piles is configured to be inserted into the second end of a second pile until a first distal edge thereof contacts the seating shoulder of the second pile.

20 Claims, 4 Drawing Sheets

PILE WITH POSITIVE STOP

BACKGROUND

In many applications, elongate tubes or pipes, also known as piles, are used to support various structures. For example, piles may be driven into the ground to support large structures that are being built on varying ground types, and generally add increased stability for the structure being built. In some installations, it may be useful to use multiple piles that are inserted into the ground and placed upon one another in series. That is, the piles may need to reach a depth beyond a length of a single pile, so a second pile may be attached to the first pile in series, which may be followed by, e.g., a third pile, a fourth pile, a fifth pile, etc.

SUMMARY

Some embodiments of the present disclosure provide a pile system for supporting structures comprising a first pile and a second pile, the first pile being configured to be coupled with the second pile. Each of the first pile and the second pile includes a first end having a first distal edge, a second end having a second distal edge, an elongate body, a transition region, and an annular seating shoulder. The elongate body can extend from the first end toward the second end and define an internal cavity with a longitudinal axis, the elongate body having a primary outer diameter and a primary inner diameter along at least 80% of a length of the elongate body. The transition region can be disposed between the elongate body and the second end, the transition region defining a secondary outer diameter. The primary outer diameter can be disposed proximate the first end, and the secondary outer diameter can be disposed proximate the second end, the secondary outer diameter being greater than the primary outer diameter.

The annular seating shoulder can be defined by an inner surface of the cylindrical elongate body. Further, the annular seating shoulder can define a step increase from the primary inner diameter to a secondary inner diameter, the secondary inner diameter being greater than the primary inner diameter. The transition region can include a convex surface and a concave surface that tangentially connect an outer surface of the second end and an outer surface of the elongate body. Further, the annular seating shoulder can include a cylindrical wall that extends circumferentially along the inner surface of the pile and an annular contact surface that is positioned perpendicular to the cylindrical wall. Moreover, the first end of the first pile can be configured to insert into the second end of the second pile until the first distal edge of the first pile contacts the annular contact surface of the second pile.

Some embodiments of the disclosure provide a pile that includes a first end, a second end, and a cylindrical, elongate body extending from the first end toward the second end. The elongate body can have a primary outer diameter and a primary inner diameter along at least 50% of a length of the elongate body. The pile can further include an internal seating shoulder disposed on an inner surface of the pile. Further, the pile can include a transition region disposed between the elongate body and the second end, the pile increasing from the primary outer diameter to a secondary outer diameter in the transition region, the pile having the primary outer diameter on a side of the transition region proximate the first end, and the pile having the secondary outer diameter on a side of the transition region proximate the second end. The secondary outer diameter can be greater than the primary outer diameter. The transition region can be configured such that the pile gradually increases from the primary outer diameter to the secondary outer diameter and an outer surface of the pile is a smooth, continuous curve within the transition region. Further, a diameter of the pile can increase within the transition region from the primary inner diameter to a secondary inner diameter, the transition region being configured such that the pile transitions from the primary inner diameter to the secondary inner diameter, and the internal seating shoulder is configured to receive the first end of a second pile.

Some embodiments of the disclosure provide a pile system for supporting structures on top of a ground surface. The pile system can be configured to extend into the ground to support the structures. Further, the pile system can include at least two piles being configured to couple to each other. The at least two piles each include a first end, a second end, and a cylindrical, elongate body extending from the first end toward the second end and defining an internal cavity with a longitudinal axis. The elongate body can have a primary outer diameter and a primary inner diameter, and the first end can have a first end outer diameter and a first end inner diameter that is equal to the primary outer diameter. The at least one pile can further include a transition region disposed between the elongate body and the second end, the pile increasing from the primary outer diameter to a secondary outer diameter in the transition region. Further, the pile can have the primary outer diameter on a side of the transition region proximate the first end, and the secondary outer diameter on a side of the transition region proximate the second end, the secondary outer diameter being greater than the primary outer diameter. The transition region can be configured such that the pile gradually increases from the primary outer diameter to the secondary outer diameter and an outer surface of the pile is a smooth, continuous curve within the transition region. Further, in the transition region, the pile can increase from the primary inner diameter to a secondary inner diameter, the transition region being configured such that the pile transitions from the primary inner diameter to the secondary inner diameter adjacent an internal shoulder disposed on an inner surface of the pile. The second end of a first pile of the at least two piles can be configured to receive the first end of a second pile of the at least two piles.

BRIEF DESCRIPTION OF THE DRAWINGS

The accompanying drawings, which are incorporated in and form a part of this specification, illustrate embodiments of the disclosure and, together with the description, serve to explain the principles of embodiments of the disclosure.

DETAILED DESCRIPTION

Figure 1:
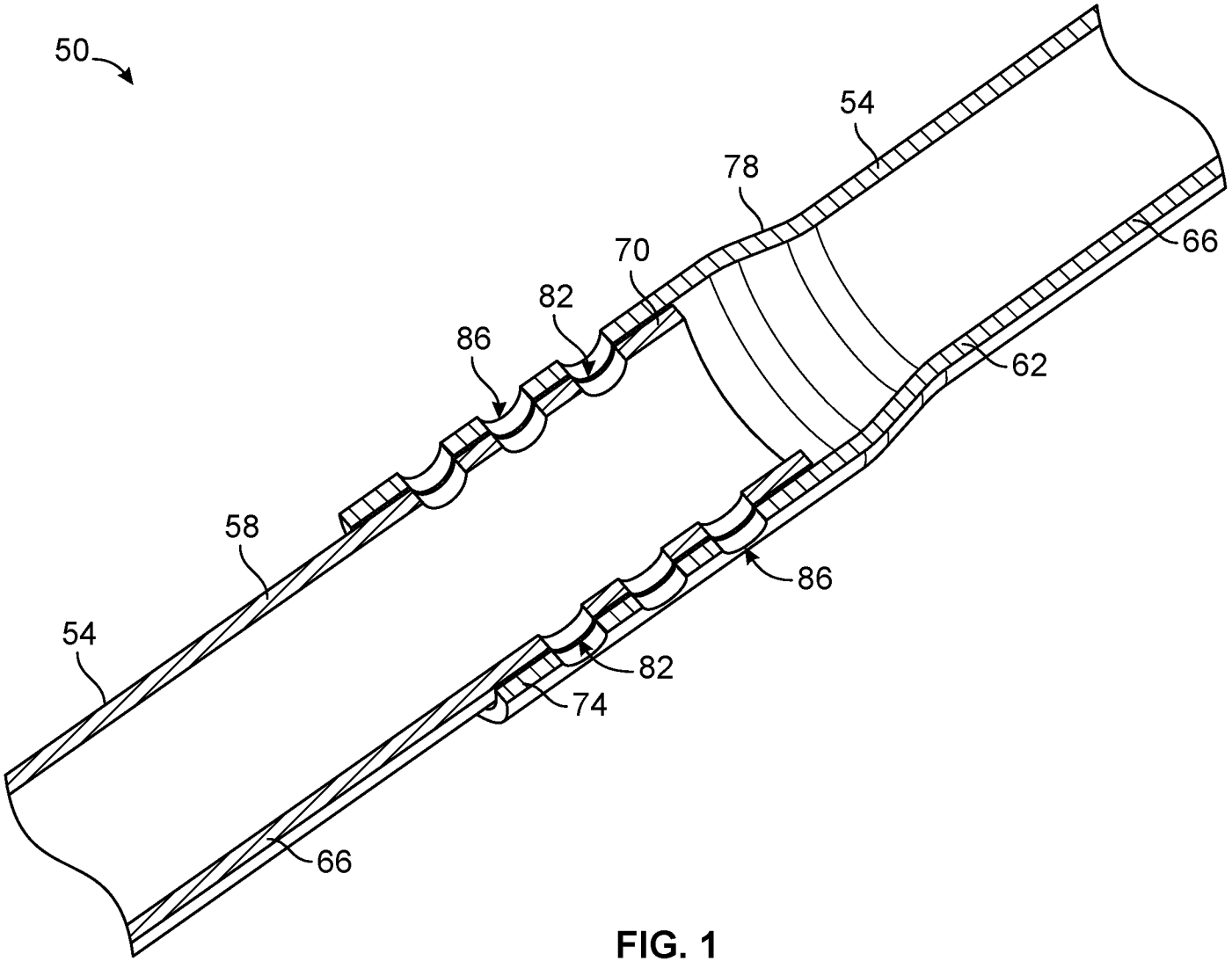
FIG. 1 (Prior Art)
FIG. 1 is a partial cross-sectional view of an existing pile system that is commonly used in the art.

Before any embodiments of the disclosure are explained in detail, it is to be understood that the embodiments disclosed herein are not limited in application to the details of construction and the arrangement of components set forth in the following description or illustrated in the following drawings. The various embodiments disclosed herein are capable of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise specified or limited, directional terms are presented only with regard to the particular embodiment and perspective described. For example, reference to features or directions as "horizontal," "vertical," "front," "rear," "left," "right," and so on are generally made with reference to a particular figure or example and are not necessarily indicative of an absolute orientation or direction. However, relative directional terms for a particular embodiment may generally apply to alternative orientations of that embodiment. For example, "front" and "rear" directions or features (or "right" and "left" directions or features, and so on) may be generally understood to indicate relatively opposite directions or features.

The following discussion is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of embodiments of the disclosure.

The terms "about" and "approximately," as used herein, refer to variations in the numerical quantity that may occur, for example, through typical measuring and manufacturing procedures used for elongate tubes or pipes or other articles of manufacture that may include embodiments of the disclosure herein; through inadvertent error in manufacturing processes; through differences in the manufacture, source, or materials used to make the articles; and the like. Throughout the disclosure, the terms "about" and "approximately" may refer to a range of values±5% of the numeric value that the term precedes.

Piles are well known for use in a wide variety of applications, including, e.g., supporting building foundations, signs and posts, and retention walls, because of their ability to provide relatively strong resistance to axial forces with minimal disturbance to the soil and very little material. Commonly, piles include helical blades for cutting into the ground as the pile is rotationally drilled into place. More specifically, a pile generally includes an elongated shaft in the form of a solid rod or hollow tube that includes one or more helical blades mounted to an end thereof. Rotation of the shaft, such as by application of a torque motor driver or hydraulic auger, results in driving the shaft into the ground via the helical blades. In many installations, the pile may be required to reach a particular depth, e.g., to reach bedrock. In some instances, the depth of the bedrock is beyond a length of the pile. To that end, the pile may be required to be driven into the ground to a depth that is deeper than the length of the shaft supporting the blade or blades. In such installations, a secondary shaft, or extension shaft, may be attached at the primary shaft's trailing end. Successive extension shafts may be used in series until the desired or required depth is reached.

Generally, securing a secondary shaft to a primary shaft is accomplished in the field by aligning a socket or collar that is mounted to the end of one of the shafts with a corresponding or mating end of the other shaft such that mounting holes thereof align to receive fasteners therethough. Because this procedure is typically done on-site, is frequently conducted repeatedly during a single construction project, and requires sufficient precision, it can be time consuming. For example, aligning the holes of the shafts commonly requires incremental adjustments before the holes are sufficiently aligned for receiving a fastener therethrough. Therefore, a need exists for a pile system that facilitates precise alignment of the shafts during installation in the field, thereby enhancing installation efficiency and ease.

Referring now to FIG. 1, an existing pile system 50 is illustrated, which is commonly used in construction applications. The system 50 comprises at least one extension tube 54, which may also be referred to as a pile or pipe. In the illustrated embodiment, for example, the at least one extension tube 54 comprises a first extension tube 58 and a second extension tube 62 that are configured to be installed in series. In some instances, more than two tubes will be installed in series. However, for the sake of brevity, only two tubes are shown and discussed herein. The first extension tube 58 and the second extension tube 62 are typically identical components that each comprise an elongate shaft body 66 extending from a first end 70 to a second end 74. Only the first end 70 and the second end 74 are shown along first extension tube 58 and the second extension tube 62, respectively; however, it is to be understood that the first extension tube 58 and the second extension tube 62 also include a second end 74 and a first end 70, respectively, opposing the illustrated ends.

Still referring to FIG. 1, the elongate shaft body 66 is contiguous with the first and second ends 70, 74. Further, the elongate shaft body 66 has a substantially constant thickness, outer diameter, and inner diameter. The first end 70 has an inner diameter, outer diameter, and thickness that are substantially equal to that of the elongate shaft body 66. Thus, the elongate shaft body 66 smoothly transitions into the first end 70. The second end 74, however, differs in diameter from the first end 70 and the elongate shaft body 66. More specifically, the elongate shaft body 66 transitions into the second end 74 at a transition region 78, the transition region 78 being a region in which the inner diameter of the tube 54 gradually increases. Generally, throughout each of the elongate shaft body 66, the transition region 78, and the second end 74, the tube 54 has a substantially constant thickness.

In the example of FIG. 1, the first end 70 of the extension tube 54 is a male connector, and the second end 74 of the extension tube 54 is a female connector that is configured to receive the male connector, i.e., the first end 70. The second end 74 of the second tube 62 thus may receive the first end 70 of the first tube 58. For example, the second end 74 comprises a larger inner diameter than the first end 70 such that the second end 74 may receive the first end 70. The first end 70 is configured to be inserted into the second end 74 until openings 82 through the first end 70 align with openings 86 through the second end 74. As discussed above, coupling the two tubes 58, 62 is typically done during installation on-site. More specifically, the second tube 62 may be driven into the ground until the second end 74 approaches a surface of the ground, at which point the first tube 58 may be attached to the second tube 62.

Due to the design of the ends of the tube 54, proper alignment of the tubes, e.g., the first tube 58 and the second tube 62, can be tedious and difficult. For example, because the elongate shaft body 66 gradually transitions into the second end 74 via the transition region 78 along an inner surface thereof, over-inserting the first end 70 into the second end 74 is likely to occur, which could result in misalignment of the openings 82, 86. Similarly, in an effort to avoid over-insertion of the first tube 58 into the second tube 62, the first tube 58 may be cautiously or conservatively inserted, which may result in under-insertion thereof. Attempts to correct under-insertion and/or over-insertion may result in the opposite issue, i.e., over-insertion and under-insertion, respectively, which ultimately results in a tedious and inefficient installation process.

Embodiments of the present disclosure can help alleviate this issue, and others. For example, embodiments of the disclosure may provide a pile system that includes features that can be used to repeatedly couple pipes in series with enhanced precision. In this way, installation and assembly of pile systems that incorporate aspects of the present disclosure may require less time than existing systems, resulting in significant cost savings. Further, installation and assembly of systems incorporating aspects of the present disclosure may enhance other aspects of installation and assembly, thereby enhancing the systems.

The embodiments described below are presented in the context of piles and extension tubes or pipes intended for use in construction applications or related applications. Although these configurations can be particularly useful in construction applications, in part due to the frequency of installation, construction site conditions, and necessity for efficiency during construction projections, other configurations are possible. For example, the principles disclosed herein can be used with pipes and tubes intended for use in a variety of applications, such as, e.g., ceiling and/or wall structures, plumbing, HVAC, automobile frames and components, nautical vessels and accessories, light fixtures, and so on. Further, while embodiments of the disclosure are presented in the context of cylindrical pipes, embodiments of the disclosure may be used with pipes and articles having different shapes. For example, the present disclosure may be particularly useful with pipes having square, rectangular, or oval cross-sections.

Figure 2:
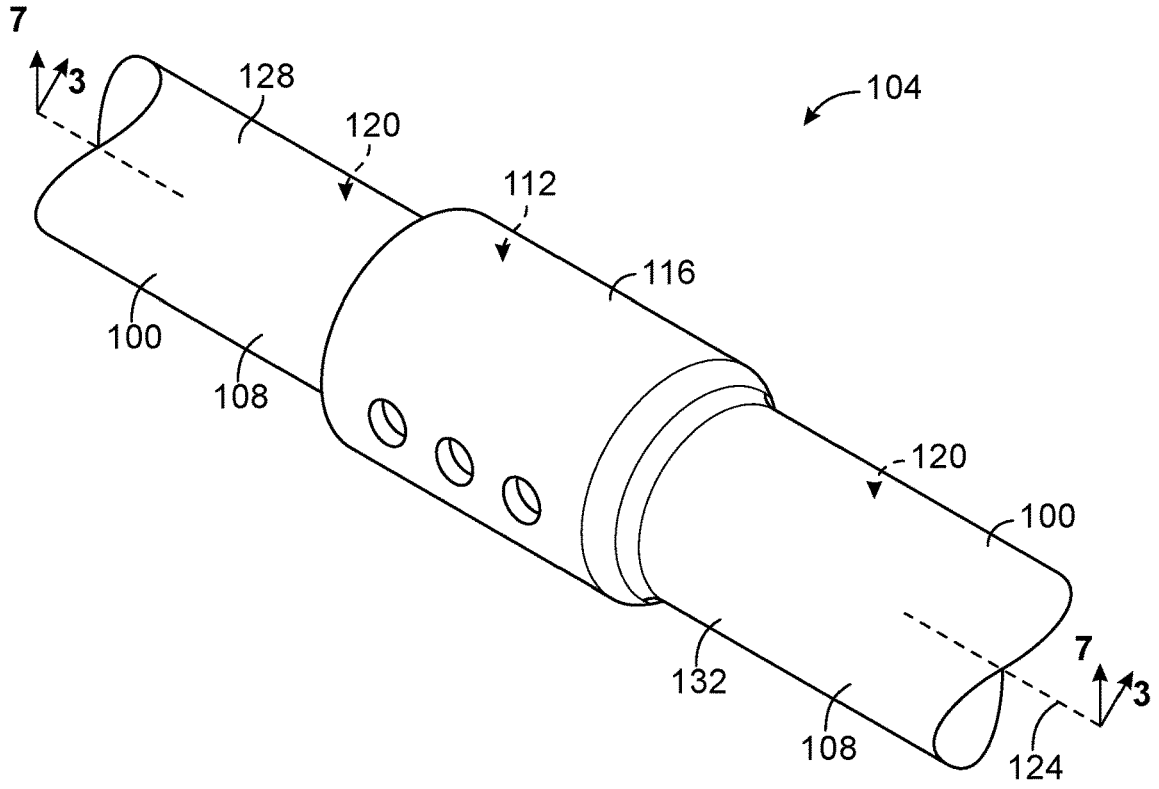
FIG. 2 is a partial isometric view of a pile system according to an embodiment of the present disclosure.
Figure 3:
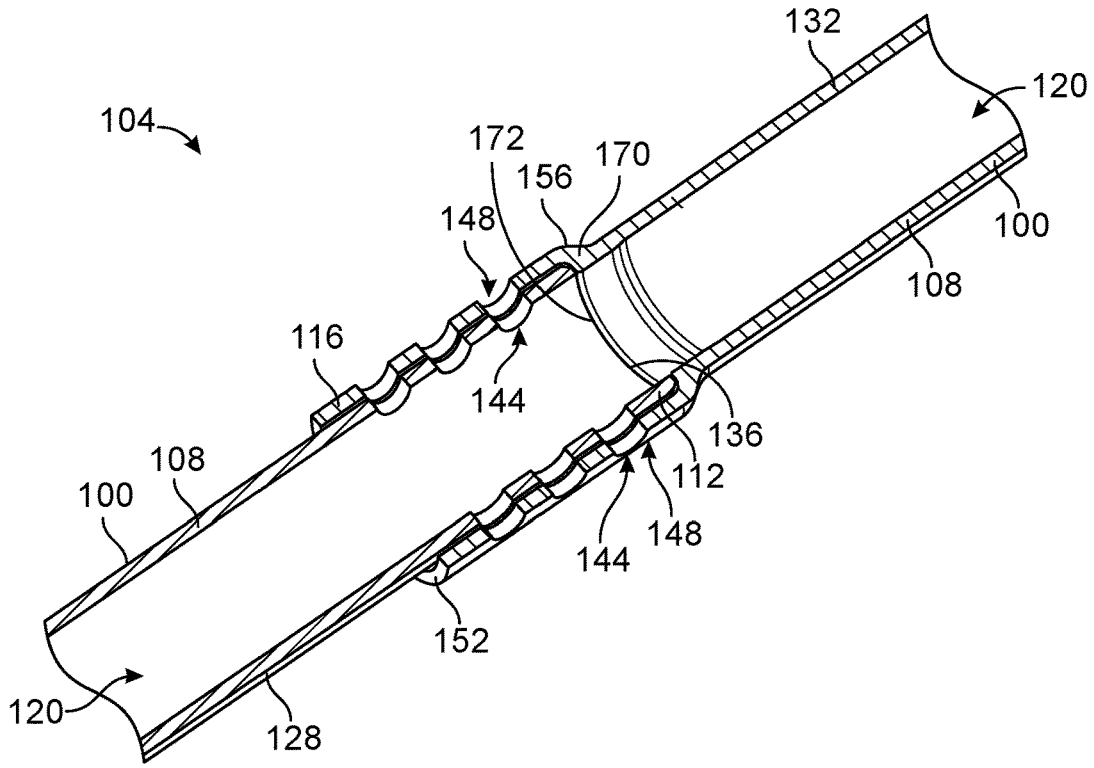
FIG. 3 is a partial cross-sectional view of the pile system taken through line 3-3 of FIG. 2, which highlights a first pile and a second pile.

Referring to FIGS. 2 and 3, the present disclosure generally provides a pile 100 for use in a pile system 104 for aligning and securing at least two of the piles 100 in series. The pile 100, which may also be referred to as a tube or pipe herein, is generally a cylindrical component having an elongate hollow shaft body 108 extending from a first end 112 toward a second end 116. The body 108 defines an internal passage 120 and has a longitudinal axis 124. In the illustrated embodiment, for example, the pile system 104 includes two piles 100, which will be referred to as a first tube 128 and a second tube 132 for description purposes, and may be configured to be driven into a ground surface, such as soil of a construction site. It should be understood that the first tube 128 and the second tube 132 are duplicates of a single component, i.e., the pile 100, and are substantially identical to one another.

For the sake of clarity and brevity, opposing ends of the first tube 128 and the second tube 132 are shown in FIGS. 2-7. Therefore, it should be understood that description of the first tube 128 may also be applicable to the second tube 132, and vice versa. For example, FIG. 3 illustrates a partial cross-sectional view of the first tube 128 with the first end 112 and the second tube 132 with the second end 116. However, an end of the first tube 128 opposing the first end 112 may be substantially identical to the second end 116 of the second tube 132 illustrated in the figures. Similarly, an end of the second tube 132 opposing the second end 116 may be substantially identical to the first end 112 of the first tube 128 illustrated in the figures. Consequently, as discussed above, the first tube 128 and the second tube 132 may be substantially identical and each may include the first end 112 and the second end 116 connected by the elongate shaft body 108.

Figure 4:
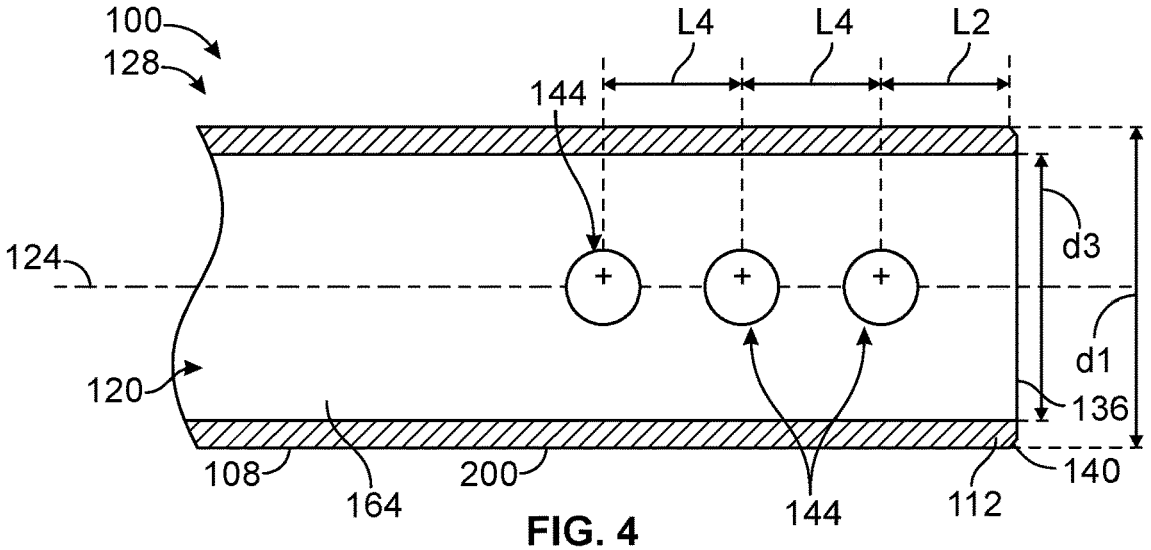
FIG. 4 is a partial cross-sectional view of the first pile of FIG. 3.

FIG. 4 illustrates the first end 112 in detail. Generally, the first end 112 may be an extension of the elongate shaft body 108. More specifically, in the illustrated embodiment, the elongate shaft body 108, which may have a substantially constant inner diameter and thickness along a length thereof, may simply extend into the first end 112 ending at a first distal edge 136. Thus, the first end 112 may be contiguous with and have the same inner diameter and thickness as the elongate shaft body 108. In some embodiments, however, the first end may include a different inner diameter, outer diameter, and/or thickness than the elongate shaft body. For example, the elongate shaft body may transition into the first end by gradually or abruptly reducing its inner diameter. Alternatively, the first end may have a larger inner diameter, thickness, and/or outer diameter. For example, the elongate shaft body may transition into the first end by gradually or abruptly increasing its inner diameter.

Still referring to FIG. 4, the first distal edge 136 may include a chamfer 140. The chamfer 140 may assist with insertion of the first end 112 into a mating component, such as, e.g., the second end 116 shown in FIG. 5. In some embodiments, the chamfer 140 may be about 30 degrees, about 45 degrees, or about 60 degrees with various lengths, such as, e.g., about 0.12 inch ("in."), about 0.125 in. or about 0.13 in. Moreover, in the illustrated embodiment, the first distal edge 136 is substantially circular and is disposed in a plane that is substantially perpendicular to the longitudinal axis 124 of the tube 128. However, in some embodiments, the first edge may be disposed in a plane that is angled relative to the longitudinal axis of the tube. Further, in some embodiments, the first edge may be non-planar and/or non-circular.

With continued reference to FIG. 4, the first end 112 further includes a plurality of openings 144 configured to receive and retain fasteners (not shown). More specifically, the openings 144 may receive fasteners, such as threaded bolts or rods, which are configured to secure the first end 112 to an end of a mating component, such as, e.g., the second tube 132 shown in FIG. 5. In the illustrated embodiment, the first end 112 includes three openings 144 that extend completely through the first end 112, which will be described in greater detail below. In operation, a fastener may extend into one of the openings 144 from a first side of the tube 128, through the internal passage 120 until it exits through the opposing side of the tube 128. It should be understood, however, that tubes according to embodiments of the present disclosure may include more, fewer, or no openings. Further, although the openings of the illustrated embodiment are disposed linearly along a length of the first tube 128 such that they extend substantially parallel to the longitudinal axis 124, the openings may be helically or non-linearly disposed in alternative embodiments.

Figure 5:
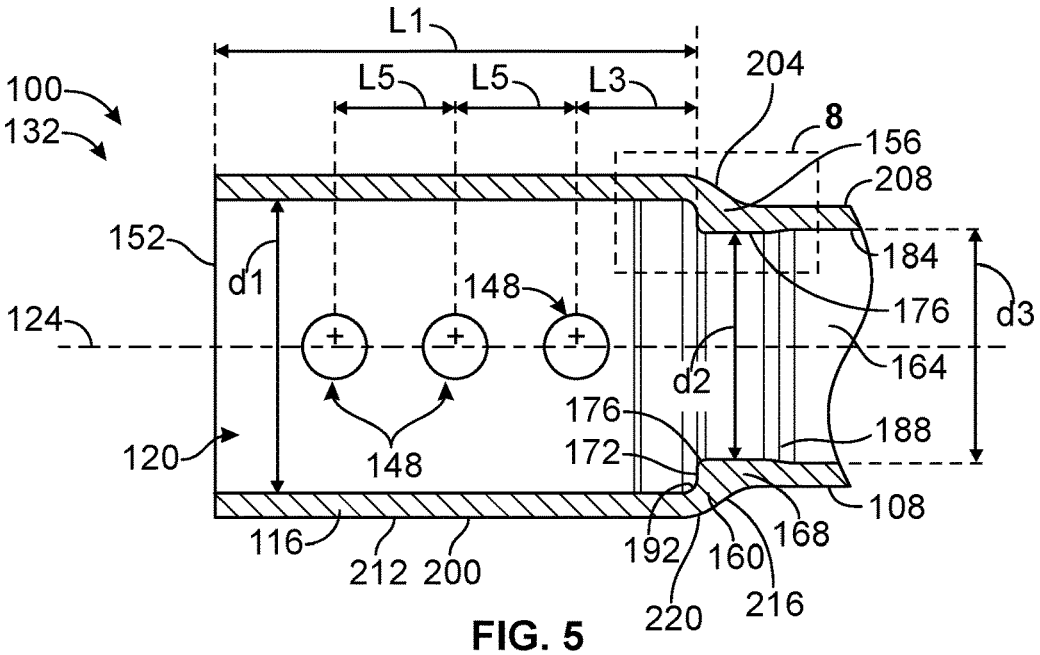
FIG. 5 is a partial cross-sectional view of the second pile of FIG. 3.

As discussed above, the first end 112 of the first tube 128 may be configured to couple to a mating component. FIG. 5 illustrates a cross-sectional view of the second end 116 of the second tube 132, which may be configured to receive the first end 112 of the first tube 128 shown in FIG. 4. In the illustrated embodiment, and as discussed above, the second tube 132 is substantially identical to the first tube 128, with FIG. 5 showing the second end 116 thereof that would oppose a first end, e.g., the first end 112 shown with respect to the first tube 128 in FIG. 4. The elongate shaft body 108 is contiguous with the second end 116, the second end 116 extending from the elongate shaft body 108 to a second distal edge 152. However, the elongate shaft body 108 does not transition into the second end 116 as fluidly as it does the first end 112 (see FIG. 4). Rather, the second end 116 has a diameter that differs with respect to a diameter of the elongate shaft body 108.

Figure 6:
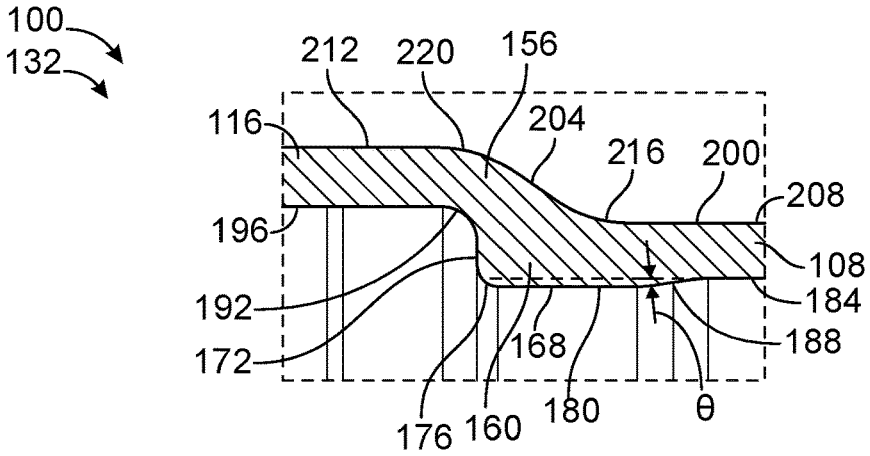
FIG. 6 is a detail view of a seating shoulder of the second pile FIG. 5.

More specifically, the elongate shaft body 108 transitions into the second end 116 at a transition region 156, the transition region 156 being a region through which an inner diameter and an outer diameter of the second tube 132 changes. In the illustrated embodiment, the transition region 156 comprises an annular seating shoulder 160, also referred to as a positive stop, disposed on an internal surface 164 of the tube 132 at the transition region 156. As best illustrated in FIG. 6, the seating shoulder 160 defines a step increase in diameter from the elongate shaft body 108 to the second end 116. Thus, the second end 116 has an inner diameter that is greater than an outer diameter of the elongate shaft body 108 and the first end 112 (see FIG. 4). Correspondingly, the second end 116 in the illustrated embodiment has a greater outer diameter than the outer diameter of the elongate shaft body 108 and the first end 112 (see FIG. 4). In some embodiments, however, the second end may have an inner and/or outer diameter that is smaller than a corresponding diameter of the elongate shaft body.

Still referring to FIG. 6, the seating shoulder 160 of the transition region 156 is shown in detail. The seating shoulder 160 may include a cylindrical wall portion 168 connected to an annular contact surface 172 by an external transition edge 176. More specifically, the cylindrical wall portion 168 includes a cylindrical wall surface 180 that may be concentric with the elongate shaft body 108. As illustrated in FIG. 5, the second end 116 comprises an inner diameter d1. The cylindrical wall portion 168 and the elongate shaft body 108 may share the common longitudinal axis 124. The cylindrical wall surface 180 may be substantially level and have a substantially constant inner diameter d2. Still referring to FIG. 5, the inner diameter d2 of the cylindrical wall portion 168 may be slightly smaller than an inner diameter d3 of the elongate shaft body 108. Therefore, in the illustrated embodiment, the tube 132 reduces its inner diameter when it transitions from the elongate shaft body 108 to the transition region 156. Put differently, an inner diameter of the pile 100 decreases when transitioning from the elongate body 108 to the transition region 156 from the inner diameter d3 to the inner diameter d2 and increases within the transition region 156 from the inner diameter d2 to the inner diameter d1. Therefore, the inner diameter d2 is smaller than and positioned between the inner diameter d3 and the inner diameter d1. The inner diameter d1 is positioned between the second distal edge 152 and the inner diameter d2, i.e., the cylindrical wall portion 168. The inner diameter d3 is positioned between the first distal edge 136 and the inner diameter d2. The inner diameter d1 is larger than the inner diameter d2 and the inner diameter d3. The inner diameter d3 is larger than the inner diameter d2 and smaller than the inner diameter d1.

In the illustrated embodiment, the tube 132 gradually transitions from the inner diameter d3 of the elongate shaft body 108 to the inner diameter d2 of the cylindrical wall portion 168. More specifically, and referring to FIG. 6, an inner surface 184 of the elongate shaft body 108 and the cylindrical wall surface 180 may be substantially parallel in the axial direction, and a connecting angled surface 188 may connect the two surfaces 184, 180. The connecting angled surface 188 may extend from the inner surface 184 of the elongate shaft body 108 at an angle θ, which is preferably less than 20 degrees. In some embodiments, the angle θ is less than 10 degrees. Furthermore, the connecting angled surface 188, the inner surface 184 of the elongate shaft body 108, and the cylindrical wall surface 180, may be smoothly connected to define a curved, un-interrupted, and fluid surface. That is, each of the connecting angled surface 188, the inner surface 184 of the elongate shaft body 108, and the cylindrical wall surface 180 may transition between each other without sharp corners or edges.

While the embodiment illustrated has the connecting angled surface 188 disposed between and connecting the cylindrical wall surface 180 and the inner surface 184 of the elongate shaft body 108, some embodiments may include a cylindrical wall surface that is even with an inner surface of the elongate shaft. That is, in some embodiments, an inner diameter of the cylindrical wall may be substantially equal to an inner diameter of the elongate shaft body such that the inner surfaces thereof of are continuous and smooth, i.e., substantially without curves, ridges, bumps, and/or steps along the axial direction. Furthermore, the cylindrical wall portion and the elongate shaft body may be connected by different structures. For example, in some embodiments, the inner surface of the elongate shaft portion may transition to the inner surface of the cylindrical wall portion via a step. The step may be abrupt or sharp in some embodiments, whereas the step may be filleted or gradual in other embodiments. Moreover, in some embodiments, an inner diameter of cylindrical wall portion may be greater than the inner diameter of the elongate shaft body. The transitioning features discussed above, e.g., angled surfaces, steps, filleted edges, etc., may also be used in such embodiments.

Still referring to FIG. 6, in the embodiment illustrated, the external transition edge 176 is a filleted edge that connects the cylindrical wall surface 180 to the annular contact surface 172. More specifically, the external transition edge 176 is curved such that it tangentially connects to each of the cylindrical wall surface 180 and the annular contact surface 172. In the illustrated embodiment, the cylindrical wall surface 180 is substantially perpendicular to the annular contact surface 172. Thus, the annular contact surface 172 is disposed in a plane that is substantially perpendicular to the longitudinal axis 124 (see FIG. 5) of the tube 132. In other embodiments, however, the cylindrical wall surface 180 and/or the annular contact surface 172 may be angled differently relative to each other and/or the longitudinal axis 124 of the tube 132. Because the cylindrical wall surface 180 and the annular contact surface 172 are substantially perpendicular in the present embodiment, and because the external transition edge 176 is tangentially joined to both the cylindrical wall surface 180 and the annular contact surface 172, the external transition edge 176 may generally define a 90 degree curve.

As shown in the cross-sectional view of FIG. 6, the external transition edge 176 may be a curve that extends for approximately 90 degrees. That is, a cross-section of the external transition edge 176 may define an approximately 90 degree arc. In the illustrated embodiment, the external transition edge 176 has a radius of curvature of less than about 0.1 in. In some embodiments, the radius of curvature of the external transition edge may be less than about 0.5 in., about 0.3 in., about 0.2 in., or 0.096 in. Preferably, the radius of curvature of the external transition edge is between about 0.08 in. and about 0.1 in. However, the radius of curvature of the external transition edge may be a different value in alternative embodiments. Further, the external transition edge may lack a radius of curvature in alternative embodiments. For example, the external transition edge may include a chamfer or a straight edge instead of a fillet.

Figure 7:
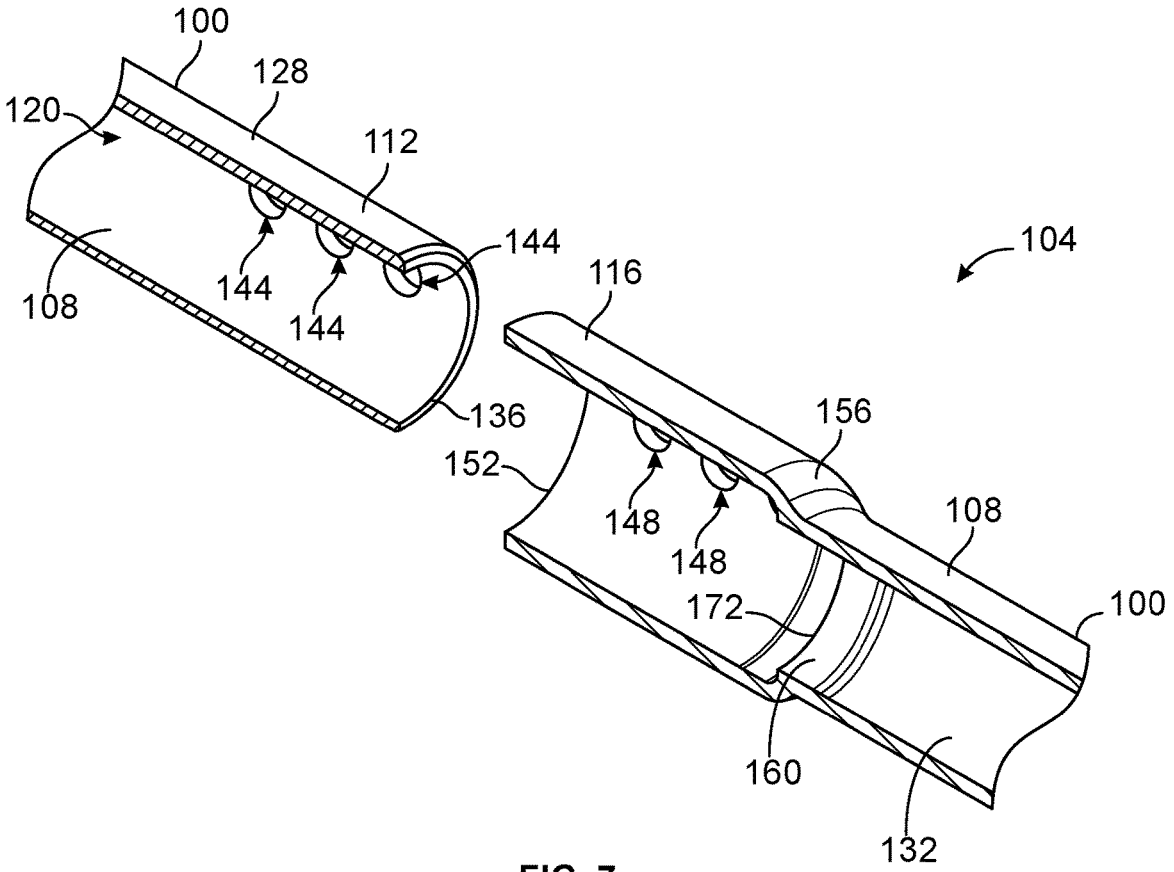
FIG. 7 is an exploded, partial cross-sectional view of the pile system taken through line 7-7 of FIG. 3.

With continued reference to FIG. 6, an internal transition edge 192 may be similarly disposed between the annular contact surface 172 and an inner surface 196 of the second end 116. Similar to the external transition edge 176, the internal transition edge 192 may be a filleted edge that gradually connects the inner surface 196 of the second end 116 with the annular contact surface 172 such that the internal transition edge 192 is substantially free of sharp corners. More specifically, the internal transition edge 192 may be curved such that it tangentially connects to each of the inner surface 196 of the second end 116 and the annular surface 172. As best illustrated in FIG. 7, the inner surface 196 of the second end 116 extends substantially perpendicularly to the annular contact surface 172. However, other embodiments may include an inner surface of the cylindrical wall portion and/or the annular surface that is angled differently relative to one another and/or the longitudinal axis of the pipe.

Because the inner surface 196 and the annular contact surface 172 are substantially perpendicular in the present embodiment, and because the internal transition edge 192 is tangentially joined to both the inner surface 196 and the annular contact surface 172, the internal transition edge 192 may generally define a 90 degree curve. As illustrated in FIG. 6, a cross-section of the internal transition edge 192 may define approximately a 90 degree arc. In the illustrated embodiment, the internal transition edge 192 has a radius of curvature of less than about 0.2 in. In some embodiments, the radius of curvature of the internal transition edge is less than about 0.5 in., about 0.3 in., about 0.25 in., or about 0.19 in. Preferably, the radius of curvature of the internal transition edge is between about 0.15 in. and about 0.2 in. However, the radius of curvature of the internal transition edge may be a different value in alternative embodiments. Further, the internal transition edge may lack a radius of curvature in alternative embodiments. For example, the internal transition edge may include a chamfer or a straight edge instead of a fillet.

An outer surface 200 of each pile 100, i.e., outer surfaces of the first tube 128 and the second tube 132, may generally exhibit a smooth transition between the elongate shaft body 108 and the second end 116. Referring to FIG. 6, an outer surface 204 of the transition region 156 may include a series of tangential curves that connect an outer surface 208 of the elongate shaft body 108 and an outer surface 212 of the second end 116. In the illustrated embodiment, the outer surface 204 of the transition region 156 includes a concave curve 216 and a convex curve 220, the concave curve 216 being adjacent the elongate shaft body 108, and the convex curve 220 being adjacent the second end 116. Both the convex curve 220 and the concave curve 216 may tangentially transition into the outer surface 212 of the second end 116 and the outer surface 208 of the elongate shaft body 108, respectively, such that no sharp or abrupt corners or edges exist. Similarly, the convex curve 220 and the concave curve 216 may tangentially transition into each other free of sharp or abrupt corners or edges. Thus, in the present embodiment, the outer surface 200 of the tube 132 along the elongate shaft body 108, the transition region 156, and the second end 116 may generally define an S-curve comprising the concave curve 216 and the convex curve 220, the S-curve gradually increasing the outer diameter of the tube.

Still referring to FIG. 6, the concave curve 216 may have a radius of curvature less than about 1 in. In some embodiments, the radius of curvature may be less than about 0.9 in, about 0.8 in, about 0.6 in, or about 0.55 in. In some embodiments, the radius of curvature of the concave curve is between about 0.4 in and about 0.6 in. In some embodiments, the radius of curvature of the concave curve is between about 0.45 in and about 0.5 in. Preferably, the radius of curvature of the concave curve is about 0.5 in. Similarly, the convex curve 220 may have a radius of curvature of less than about 1 in. In some embodiments, the radius of curvature may be less than about 0.9 in. or about 0.8 in. In some embodiments, the radius of curvature of the convex curve is between about 0.7 in and about 0.9 in. Preferably, the radius of curvature of the convex curve is about 0.75 in. Further, in the illustrated embodiment, the radius of curvature of the convex curve 220 is greater than the radius of curvature of the concave curve 216. However, in alternative embodiments, the radius of curvature of the convex curve may be less than or equal to the radius of curvature of the concave curve.

Figure 8:
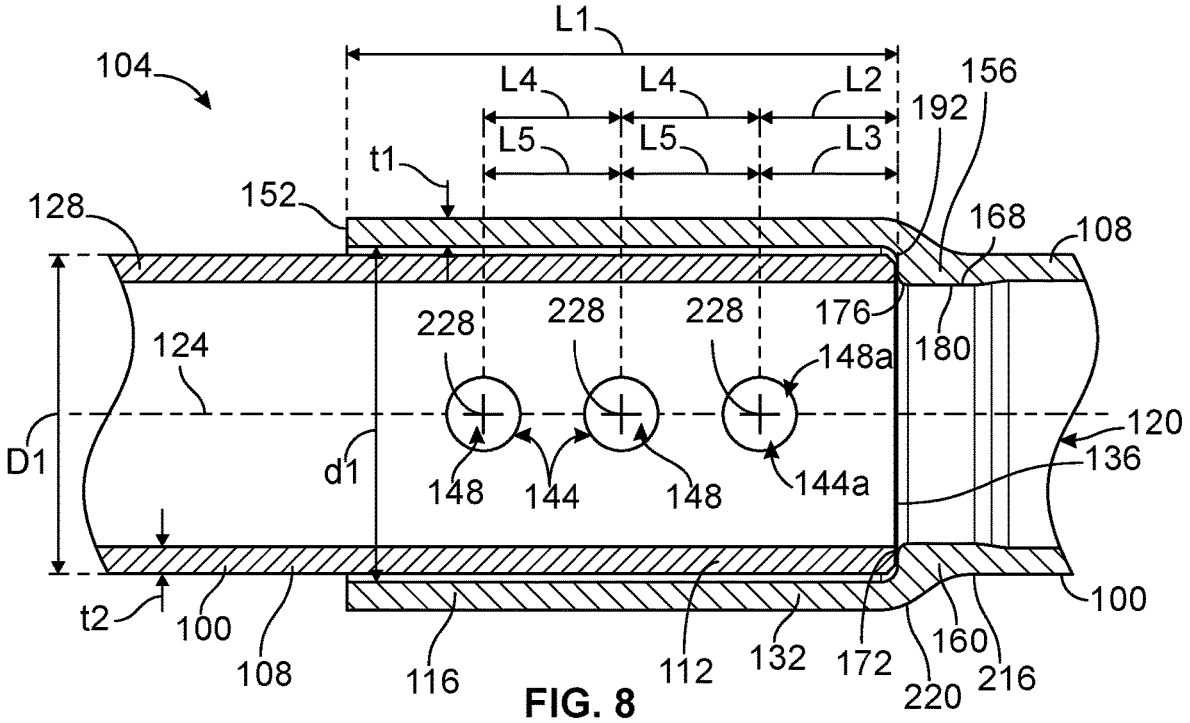
FIG. 8 is a partial cross-sectional view of the pile system of FIG. 7.

Referring now to FIGS. 7 and 8, the first tube 128 and the second tube 132 are shown in a separated configuration and a coupled configuration, respectively. The second end 116 is sized so the first end 112 may be received by the second end 116, which allows the first tube 128 and the second tube 132 to be removably coupled to one another. It necessarily flows that the inner diameter d1 of the second end 116 is greater than an outer diameter D1 of the first end. In some embodiments, the inner diameter d1 of the second end 116 may be at least 0.03 in. or about 0.5 in. greater than the outer diameter D1 of the first end. The second end 116 has a wall thickness t1 that is substantially equal to a wall thickness t2 of the elongate shaft body 108 and the first end 112 (see FIG. 4). However, alternative embodiments may have a second end with a wall thickness that is greater than or less than a wall thickness of the elongate shaft body and/or the first end. Referring to FIGS. 5 and 6, the cylindrical wall surface 180 of the cylindrical wall portion 168, which defines the inner diameter d2, is substantially parallel with the inner surface 196 of the second end 116, which defines the inner diameter d1, and the inner surface 184 of the elongate shaft body 108, which defines the inner diameter d3.

While exemplary dimensions are provided herein, it should be understood that aspects of the present disclosure may be incorporated into tubes having a variety of shapes and sizes. Generally, embodiments of the present disclosure, such as the embodiment shown in FIGS. 7 and 8, include tubes having a substantially uniform wall thickness along a length thereof. For example, the tube may have a uniform wall thickness along at least about 50%, about 60%, about 70%, about 80%, or about 90% of the tube's axial length. In some embodiments, a tube may have a substantially uniform wall thickness along its entire length except for the transition region and the second end. That is, the wall thickness t2 may be substantially constant from the first distal edge 136 to the transition region 156, and the wall thickness may vary within the transition region 156 and the second end 116. In some embodiments, the second end 116, i.e., from the transition region 156 to the second distal edge 152, may have a substantially uniform wall thickness.

The wall thickness of a tube may depend on the tube's diameter. More specifically, a tube having a larger diameter (inner or outer) may have a larger wall thickness than a tube having a smaller diameter. For example, one common pile configuration has an outer diameter of 3.50 in. The outer diameter of 3.50 in. is associated with the first end outer diameter, i.e., the outer diameter D1 of the first end 112 (see FIG. 8), which may also be associated with an outer diameter of the elongate body 108 and may be referred to as a primary outer diameter. In this exemplary embodiment, the tube may have a wall thickness t2 of about 0.30 in. The wall thickness may vary from this exemplary value in that the wall thickness may be selected for any number of reasons. Other common piles may include primary outer diameters of about 0.15 in., about 0.20 in., about 0.22 in., about 0.25 in., about 0.27 in., about 0.30 about 0.5 in., about 1.0 in., about 1.5 in., about 2.875 in., about 5 in., about 7.5 in., about 10 in., or larger.

Furthermore, aspects of the present disclosure may be incorporated into tubes of a variety of lengths. For purposes of discussion, a length of the tube may be measured from a first distal end to a second distal end, i.e., the first distal edge 136 of the first end 112 to the second distal edge 152 of the second end 116. Some common lengths may include 5 feet ("ft."), 7 ft., 8 ft., 10 ft., and 12 ft., for example. Tubes of varying lengths may be used in series to reach a required depth when being installed into the ground. For example, if tubes according to embodiment of the present disclosure are being used to support a structure that is being installed at a site having bedrock located approximately 50 ft. below a ground surface, a combination of varying tube lengths may be used in series to reach the bedrock.

Returning now to FIG. 7, the second end 116 is generally configured to receive and retain the first end 112. More specifically, the second end 116 may be configured such that the first distal edge 136 contact or is otherwise positioned adjacent the annular seating shoulder 160. Accordingly, the first distal edge 136 may be configured to seat on, abut, forcibly press, and/or be disposed adjacent the annular contact surface 172 of the annular seating shoulder 160, as shown in FIG. 8. In some embodiments, the first distal edge 136 preferably contacts the annular contact surface 172. In alternative embodiments, the first distal edge 136 may only approach or be proximate the annular contact surface 172. The proximity of the first distal edge 136 to the annular contact surface 172 depends primarily on lengths of the first and second ends 112, 116 and the position of openings 144, 148 respectively thereon, which will be described in detail below.

Each of the first end 112 and the second end 116 include the plurality of openings 144, 148, respectively, that may be configured to be aligned with one another and receive fasteners, such as threaded bolts, rods, or studs, therethrough. Each opening 144, 148 is generally a hole that extends entirely through one of the first and second ends 112, 116. More specifically, each of the openings 144 on the first end 112 is an opening that extends into the first end 112 through a side wall thereof and out of the first end 112 through the side wall on an opposing side thereof. Generally, the openings 144 may be aligned such that an opening center axis 228 intersects and is perpendicular to the longitudinal axis of the tube. The aforementioned general characteristics may also apply to the openings 148 of the second end 116.

As shown in FIG. 8, a length L1 between the second distal edge 152 and the annular seating shoulder 160 along with other dimensional aspects of the first and second ends 112, 116 may be designed and selected so that the first distal edge 136 contacts with the seating shoulder 160 when the openings 144, 148 are substantially aligned. The openings 144, 148 may be substantially axially aligned when the first end 112 is inserted into the second end 116 until the first distal edge 136 contacts the annular seating shoulder 160. In this way, assembly of the first and second tubes 128, 132 in series is substantially eased because axial alignment uncertainty may be eliminated.

A distance L2 represents a distance between the first distal edge 136 and a center point of an opening 144*a* of the plurality of openings 144 that is positioned closest to the first distal edge 136 taken along the longitudinal axis 124. Similarly, a distance L3 is the distance between the annular contact surface 172 and a center point of an opening 148*a* of the plurality of openings 148 this is positioned closest to the annular contact surface 172 taken along the longitudinal axis 124. Preferably, because alignment of the openings 144, 148 should be a result of the first distal edge 136 contacting the annular contact surface 172, the distance L2 and the distance L3 should be substantially similar. The distance L2 may be less than about 3.0 in., about 2.5 in., or about 2 in. Preferably, the distance L2 is between about 1.25 in. and about 1.75 in., or about 1.5 in. Correspondingly, the distance L3 may be less than about 3.0 in., about 2.5 in., or about 2 in. Preferably, the distance L3 is between about 1.25 in. and about 1.75 in. In the illustrated embodiment, the distance L3 is about 1.525 in. Thus, in some embodiments, such as the illustrated one, the distances L2 and L3 may vary slightly to account for tolerances. Preferably, a difference between the distance L2 and the distance L3 is less than about 0.1 in. Even more preferable, the difference between the distance L2 and the distance L3 is less than about 0.05 in. Furthermore, it should be understood that the distances L2 and L3 may have a variety of different values. For example, the distance L2 and/or the distance L3 may be greater than 2.0 in., 3.0 in., 5.0 in., or 10 in.

Moreover, each of the plurality of openings 144 on the first end 112 is spaced from each other by the distance L4, and each of the plurality of openings on the second end 116 is spaced from each other by a distance L5. Because each of the openings 144 on the first end 112 must generally align with the openings 148 on the second end 116 when assembled, the distance L4 and the distance L5 are preferably substantially equal. In some embodiments, the distance L4 is less than about 4.0 in., about 3.0 in., or about 2.0 in. In some embodiments, the distance L4 may be between about 1.25 in. and about 1.75 in. In some embodiments, the distance L4 may be between about 1.4 in. and about 1.6 in. or between about 2.8 in. and about 3.2 in. Similarly, the distance L5 may be less than about 4 in., about 3 in., or about 2 in. In some embodiments, the distance L5 may be between about 1.25 in. and about 1.75 in. In some embodiments, the distance L5 may be between about 1.4 in. and about 1.6 in. or between about 2.8 in. and about 3.2 in. In the illustrated embodiment, the distances L4 and L5 are about 1.50 in.

However, in some embodiments, the distances L4 and L5 may differ as a result of manufacturing tolerances. Preferably, a difference between the distances L4 and L5 is no greater than about 0.1 in. Even more preferable, the difference between the distances L4 and L5 is less than about 0.05 in. Furthermore, while each of the openings 144 on the first end 112 are evenly distributed in the illustrated embodiment, one or more openings may be unevenly distributed on the first end in alternative embodiments. Similarly, while each of the openings 148 on the second end 116 are evenly distributed in the illustrated embodiment, one or more openings on the second end may be unevenly distributed in alternative embodiments.

Still referring to FIG. 8, the openings 148 are evenly spaced and/or centrally disposed along the second end 116. To that end, the second end length L1 may be a function of the quantity of the plurality of openings 148 and the distance L5 between each of the openings. Further, in some embodiments, the length L1 of the second end 116 may relate to a total length of the second tube 132, i.e., it may vary according to different lengths. In some embodiments, however, the length L1 of the second end 116 may be consistent for tubes of different lengths. The length L1, which may be measured from the second distal edge 152 to the annular contact surface 172, may be greater than about 4.0 in., about 5.0 in., or about 6.0 in. In some embodiments, the length L1 may be between about 5.5 in. and about 6.5 in. Preferably, the length L1 is between about 5.75 in. and about 6.75 in. In the illustrated embodiment, the length L1 is about 6.025 in.

Referring again to FIG. 8, there are three of the openings 144 provided along the first end 112 and three of the openings 148 provided on the second end 116. Other embodiments may have more or fewer openings on the first end and/or the second end. Generally, embodiments may include the same number of openings on the first and second ends; however, having the same number of openings is not necessarily required. For example, if supply limitations exist, a tube having two openings on the second end may be coupled to a tube having three openings on the first end by only inserting fasteners through two of the three openings. Furthermore, while each of the openings 144, 148 along the first end 112 and the second end 116 are shown in axial alignment, i.e., along a linear path along the tubes, axial alignment is not necessary. In some embodiments, the openings 144, 148 may be disposed along a non-linear path, e.g., staggered or helically-spaced. For any pattern or positioning of openings along ends of tubes, it is preferable for the mating ends, i.e., the first end that is configured to mate with the second end, to having openings arranged in a way such that they substantially match or are capable of alignment.

Further, the first tube 128 and the second tube 132 of the illustrated embodiment are designed so that the openings 144, 148 align when the first tube 128 is substantially or completely received by the second tube 132, i.e., the coupled configuration shown in FIG. 8. When the first distal edge 136 of the first tube 128 is contacting or abuts the annular contact surface 172, the openings 144, 148 align such that fasteners may be inserted therethrough. This process may be done on-site, i.e., on a construction site when (or as) the tubes are being drilled into the ground. For example, a pile, such as the second tube 132, may be drilled into the ground until the second end 116 approaches the ground surface. At that point, another pile, such as the first tube 128, may be attached to the second tube 132 by inserting the first end 112 thereof into the second end 116 of the second tube 132. Preferably, the first end 112 is inserted until it can no longer be inserted, i.e., until the first distal edge 136 contacts the annular contact surface 172. When the first distal edge 136 contacts the annular contact surface 172, the pipes may be properly axially aligned. Therefore, the only alignment that may require adjustment is circumferential alignment. For example, the second tube 132 might require incremental rotation about the longitudinal axis 124 to properly align the openings 148 thereof with the openings 144 of the first tube 128 so that fasteners, such as threaded bolts, rods, or studs, may be inserted therethrough to securely couple the pipes. From this point, the tubes 128, 132, which are securely coupled, may be further driven into the ground. The aforementioned assembly method may be repeated until the system 104 reaches a desired depth.

Therefore, embodiments of the present disclosure may provide a critical benefit of consistent and precise axial alignment during coupling. However, alternative embodiments may incorporate additional features for circumferential alignment as well. For example, by modifying first and second ends of a plurality of piles to have an oval cross-section, circumferential alignment can be ensured. That is, by having oval cross-sections, the first end may only be inserted into the second end in two positions, a first position and a second position, the second position being 180 degrees from the first position. In this way, alignment of the openings can be consistent circumferentially in addition to radially, thereby further easing and expediting an installation process.

Tubes, or piles, according to embodiments of the present disclosure may be fabricated according to a variety of methods. For example, a tube according to an embodiment of the present disclosure may be made of a high strength material such as steel, or any other high strength metal alloy, or non-metal composite. The tube may be a unitary homogenous structure created by processes such as forging, extruding, casting, and other known manufacturing techniques. In some embodiments, the tube is a forged steel cylinder, and the mounting holes are machined or pierced. Alternatively, the sleeve may be a fabrication of two or more parts that are assembled and consolidated into a unitary structure by known processes such as welding, brazing, or autoclave bonding. Generally, however, fabricating a pile that includes aspects taught herein with welding may be costly and difficult. Therefore, a preferred method of fabrication is forging. For example, a straight tube may be forged to create the widened second end having the positive stop, i.e., the seating shoulder 160 as shown in FIG. 5.

Thus, embodiments of the disclosure can provide improved pile systems for accurately and efficiently coupling tubes. In some embodiments, for example, an improved pile according to the disclosure may include a seating shoulder on an internal surface thereof for created a stop, also referred to as a positive stop, which may limit an axial insertion of a mating pile. Thus, for example, align mating openings on a pair of piles in the field may be a simple procedure, thereby expediting an installation process.

The previous description of the disclosed embodiments is provided to enable any person skilled in the art to make or use the same. Various modifications to these embodiments will be readily apparent to those skilled in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. A pile system for supporting structures, comprising:

a first pile and a second pile, the first pile being configured to be coupled with the second pile, each of the first pile and the second pile comprising:

a first end having a first distal edge;

a second end having a second distal edge;

an elongate body extending from the first end toward the second end and defining an internal cavity with a longitudinal axis, the elongate body having a primary outer diameter and a primary inner diameter along at least 80% of a length of the elongate body, a transition region disposed between the elongate body and the second end, the transition region defining a secondary outer diameter, wherein the primary outer diameter is disposed proximate the first end, and the secondary outer diameter is disposed proximate the second end, the secondary outer diameter being greater than the primary outer diameter; and an annular seating shoulder defined by an inner surface of the elongate body, wherein the second end has a secondary inner diameter that is larger than the primary inner diameter, wherein the transition region includes a convex surface and a concave surface that tangentially connect an outer surface of the second end and an outer surface of the elongate body, wherein the annular seating shoulder includes a cylindrical wall portion that extends circumferentially along the inner surface of the elongate body and an annular contact surface that is positioned perpendicular to the cylindrical wall portion, the cylindrical wall portion having a tertiary inner diameter, the tertiary inner diameter being smaller than and positioned between the primary inner diameter and the secondary inner diameter, wherein the cylindrical wall portion defines a cylindrical wall surface that is parallel with respect to the longitudinal axis, wherein an internal transition edge is disposed between the annular contact surface and an inner surface of the second end, and wherein the internal transition edge is curved such that the internal transition edge tangentially connects to each of the inner surface of the second end and the annular contact surface, and wherein the first end of the first pile is configured to insert into the second end of the second pile until the first distal edge of the first pile contacts the annular contact surface of the second pile.

2. The pile system of claim 1, wherein each of the first pile and the second pile further comprises:

a plurality of openings along the first end, the plurality of openings along the first end extending entirely through the pile perpendicular to the longitudinal axis; and a plurality of openings along the second end, the plurality of openings along the second end extending entirely through the pile perpendicular to the longitudinal axis.

3. The pile system of claim 2, wherein the annular contact surface extends from the inner surface of the second end toward the longitudinal axis such that the annular contact surface is perpendicular to the longitudinal axis and the inner surface of the second end, and wherein the cylindrical wall portion extends from the annular contact surface toward the first end along the longitudinal axis.

4. The pile system of claim 3, wherein at least one of the plurality of openings along the first end of the first pile aligns with one of the plurality of openings on the second end of the second pile such that the aligned openings are configured to receive a fastener.

5. The pile system of claim 4, wherein each of the plurality of openings on the first end of the first pile aligns with one of the plurality of openings on the second end of the second pile such that the aligned openings are configured to receive a fastener.

6. A pile comprising:

a first end;

a cylindrical second end;

a cylindrical, elongate body extending from the first end toward the cylindrical second end and defining an internal cavity with a longitudinal axis, the elongate body having a primary outer diameter and a primary inner diameter along at least 50% of a length of the elongate body, an internal seating shoulder disposed on an inner surface of the pile, the internal seating shoulder including a cylindrical wall portion; and a transition region disposed between the elongate body and the cylindrical second end, an outer diameter of the pile increasing from the primary outer diameter to a secondary outer diameter within the transition region, the pile having the primary outer diameter on a side of the transition region proximate the first end, and the pile having the secondary outer diameter on a side of the transition region proximate the cylindrical second end, the secondary outer diameter being greater than the primary outer diameter, wherein the cylindrical second end has a secondary inner diameter and the cylindrical wall portion has a tertiary inner diameter, the tertiary inner diameter is positioned between the primary inner diameter and the secondary inner diameter, wherein the tertiary inner diameter is smaller than the primary inner diameter and the secondary inner diameter, wherein the cylindrical wall portion is parallel with respect to the longitudinal axis, wherein the transition region is configured such that an outer surface of the pile comprises a smooth, continuous S-curve within the transition region, wherein an inner diameter of the pile decreases when transitioning from the elongate body to the transition region from the primary inner diameter to the tertiary inner diameter and increases within the transition region from the tertiary inner diameter to the secondary inner diameter, and wherein the internal seating shoulder is configured to receive the first end of a second pile.

7. The pile of claim 6, wherein the cylindrical wall portion extends circumferentially along the inner surface of the pile, and wherein the internal seating shoulder includes an annular contact surface that is positioned perpendicularly to the cylindrical wall portion.

8. The pile of claim 7, wherein the cylindrical wall portion and the annular contact surface are tangentially connected via an external transition edge.

9. The pile of claim 8, wherein the external transition edge is an external fillet having a radius of curvature between about 0.08 and about 0.1 inch.

10. The pile of claim 7, wherein the annular contact surface and an inner surface of the cylindrical second end are tangentially connected via an internal transition edge.

11. The pile of claim 10, wherein the internal transition edge is an internal fillet having a radius of curvature between about 0.15 and about 0.2 inch.

12. The pile of claim 6, wherein the outer surface of the transition region includes a convex curve and a concave curve that connect the cylindrical second end and the elongate body.

13. The pile of claim 12, wherein the convex curve is adjacent the cylindrical second end, and the concave curve is adjacent the elongate body.

14. The pile of claim 13, wherein the concave curve has a radius of curvature of between about 0.4 and about 0.6 inch.

15. The pile of claim 14, wherein the convex curve has a radius of curvature of between about 0.7 and about 0.9 inch.

16. The pile of claim 6, wherein the pile is a first pile that is configured to be used with the second pile, the second pile comprising:

a first end;

a second end; and a cylindrical, elongate body extending from the first end toward the second end, the elongate body having a primary outer diameter and a primary inner diameter, the first end having a first end outer diameter and a first end inner diameter that is equal to the primary outer diameter, wherein the first end of the second pile is configured to be received by the second end of the first pile.

17. A pile system for supporting structures on top of a ground surface, the pile system being configured to extend into the ground to support the structures, the pile system comprising at least two piles being configured to couple to each other, the at least two piles each comprising:

a first end;

a second end;

a cylindrical, elongate body extending from the first end toward the second end and defining an internal cavity with a longitudinal axis, the elongate body having a primary outer diameter and a primary inner diameter, the first end having a first end outer diameter and a first end inner diameter that is equal to the primary outer diameter and the primary inner diameter, respectively; and a transition region disposed between the elongate body and the second end, an outer diameter of the pile increasing from the primary outer diameter to a secondary outer diameter in the transition region, the pile having the primary outer diameter on a side of the transition region proximate the first end, and the pile having the secondary outer diameter on a side of the transition region proximate the second end, the secondary outer diameter being greater than the primary outer diameter, wherein the transition region comprises an internal seating shoulder, the internal seating shoulder including a cylindrical wall portion, the cylindrical wall portion including a cylindrical wall surface;

wherein the transition region is configured such that an outer surface of the pile comprises a smooth, continuous S-curve within the transition region, wherein the outer surface of the transition region includes a convex curve and a concave curve that connect the second end and the elongate body, wherein the convex curve and the concave curve have substantially the same radius of curvature, wherein the second end includes an inner surface, the inner surface having a secondary inner diameter and the cylindrical wall surface having a tertiary inner diameter, the tertiary inner diameter being smaller than and positioned between the primary inner diameter and the secondary inner diameter, wherein the inner surface of the second end and the cylindrical wall surface of the cylindrical wall portion are parallel with respect to the longitudinal axis, wherein an inner diameter of the pile decreases when transitioning from the elongate body to the transition region from the primary inner diameter to the tertiary inner diameter and increases within the transition region from the tertiary inner diameter to the secondary inner diameter, and wherein the second end of a first pile of the at least two piles is configured to receive the first end of a second pile of the at least two piles.

18. The pile system of claim 17, wherein the internal seating shoulder includes an annular contact surface, the annular contact surface extending from the inner surface of the second end toward the longitudinal axis such that the annular contact surface is perpendicular to the longitudinal axis and the inner surface of the second end, and wherein the cylindrical wall portion extends from the annular contact surface toward the first end along the longitudinal axis.

19. The pile system of claim 18, wherein the cylindrical wall portion and the annular contact surface are tangentially connected via an external transition edge, and wherein the annular contact surface and the inner surface of the second end are tangentially connected via an internal transition edge.

20. The pile system of claim 19, wherein each of the at least two piles further comprises:

at least one opening on the first end, the at least one opening on the first end extending entirely through the pile perpendicular to the longitudinal axis; and at least one opening on the second end, the at least one opening on the second end extending entirely through the pile perpendicular to the longitudinal axis, wherein the first end includes a first distal edge, wherein the second end of the first pile is configured to receive the first end of the second pile until the first distal edge contacts the annular contact surface, wherein the at least one opening on the second end of the first pile aligns with the at least one opening on the first end of the second pile such that the aligned openings are configured to receive a fastener.

* * * * *